US005695010A

United States Patent [19]

Hongo

[11] Patent Number: 5,695,010

[45] Date of Patent: Dec. 9, 1997

[54] METHOD OF DRILLING AROUND AN EXISTING CASING PIPE TO REGENERATE AN OLD WELL

[75] Inventor: Kenjiro Hongo, Tokyo, Japan

[73] Assignee: Hongo Company Limited, Tokyo, Japan

[21] Appl. No.: 640,488

[22] Filed: May 1, 1996

[30] Foreign Application Priority Data

Aug. 2, 1995 [JP] Japan ..... 7-215468

[51] Int. Cl.[6] ..... E21B 31/16

[52] U.S. Cl. ..... 166/301; 166/55.6

[58] Field of Search ..... 166/298, 99, 301, 166/55.6, 55.8; 175/78, 162, 57

[56] References Cited

U.S. PATENT DOCUMENTS

| | | | |
|---|---|---|---|
| 3,785,690 | 1/1974 | Hutchinson | 166/99 X |
| 4,616,721 | 10/1986 | Furse | 166/99 X |
| 5,012,863 | 5/1991 | Springer | 166/55.7 |
| 5,253,710 | 10/1993 | Carter et al. | 166/298 |
| 5,366,029 | 11/1994 | Beck, III | 175/53 |

*Primary Examiner*—Frank Tsay
*Attorney, Agent, or Firm*—Lackenbach Siegel Marzullo Aronson & Greenspan

[57] ABSTRACT

A method of drilling the packing gravel and formation materials around an existing casing pipe in order to regenerate an old well. The method comprises the steps of sequentially filling the inside of the casing pipe of the old well with mud water, connecting drill pipe, which has an inside diameter greater than the outside diameter of the existing casing pipe of the old well and is furnished with a drill bit consisting of drill cutters and nozzles at the lower extremity, to an upper water swivel, setting the drill pipe in axial alignment with the existing casing pipe, rotating and lowering the drill pipe while sending pressurized drilling mud water through the annulus between the drill pipe and casing pipe, drilling the packing gravel and formation materials encountered surrounding the casing pipe with the drill bit, moving the cuttings up to the surface by the drilling mud water which ascends the annulus between the drill pipe and the borehole wall at the velocity greater than the descending velocity of the cuttings, separating the cuttings from the drilling mud water in a mud pit, and then circulating the pressurized drilling mud water in the annulus between the pipes for re-circulation.

2 Claims, 6 Drawing Sheets

METHOD OF DRILLING AROUND AN EXISTING CASING PIPE TO REGENERATE AN OLD WELL

BACKGROUND OF THE INVENTION

1. Field of the Invention

This invention relates to an improved method of drilling around the casing pipe of an old well in order to regenerate the old well that cannot maintain its designed pumping rate. For the purpose of this invention, "regeneration" refers to replacing the existing casing and well screen with new ones.

2. Prior Art

Japanese Patent Bulletin No. 6-173567, the publication of the patent application by the present applicant, discloses a method of regenerating an old well. Also, the Bulletin discloses the DONUT drill bit and the cutting apparatus for the casing of an old well, which are used with such a method. FIG. 5 of the accompanying drawings is a copy of FIG. 1 of the above cited patent document. Note that the parenthesized identification numbers in FIG. 5 are those found in the original drawing whereas numbers without parentheses are those relevant to the present invention.

The cited patent document describes how packing gravel (21) and formation material surrounding the casing pipe (6) of an old well is drilled by the circulating pressurized drilling mud water which is jetted from the lower end of a DONUT drill bit in sufficient quantity, but does not mention the mechanism for jetting the pressurized drilling mud water. The mechanism may be clearly understood from the description of the DONUT drill bit, which explains how a number of nozzle pipes (5) are fixed radially on the outer surface of drill pipe (2), parallel with its axis, throughout the entire length of the drill pipe, and each nozzle pipe (5) is connected to the mud water inlet chamber (4) at the top thereof and to a nozzle unit (11) at the bottom.

The fact that the DONUT drill bit used in the above cited method features independent nozzle pipes located on the drill pipe surface as passages for the pressurized drilling mud water makes the DONUT drill bit itself complicated and hence inevitably costly. Consequently, a method of regenerating an old well involving the use of such a DONUT drill bit entails complicated operations which make the entire regenerating job rather expensive.

It is, therefore, an object of the present invention to provide a method of drilling around an existing casing pipe in order to regenerate on old well.

Another object of the present invention is to provide a method of drilling by using a drill pipe that has neither nozzle pipes nor double walls, but is designed to use the existing casing pipe for circulating the pressurized drilling mud water.

Still another object of the present invention is to provide a method of drilling by jetting the pressurized mud water from the lower extremity of a drill pipe in order to enhance the drilling effect together with the drill cutters which are integrated into the lower extremity of the drill pipe.

SUMMARY OF THE INVENTION

According to the invention, the above objects are achieved by providing a method of drilling packing gravel and formation materials around an existing casing pipe in order to regenerate an old well. The method comprises the steps of sequentially filling the inside of the casing pipe of the old well with mud water, connecting a drill pipe, which has an inside diameter greater than the outside diameter of the existing casing pipe of the old well and is furnished with a drill bit consisting of drill cutters and nozzles at the lower extremity, to a water swivel, setting the drill pipe in axial alignment with the existing casing pipe, rotating and lowering the drill pipe while sending the pressurized drilling mud water through the annulus between the drill pipe and the casing pipe, drilling the packing gravel and formation materials encountered surrounding the casing pipe with the drill bit, moving the cuttings up to the surface by the drilling mud water which ascends the annulus between the drill pipe and the borehole wall at a velocity greater than the descending velocity of the cuttings, separating the cuttings from the drilling mud water in a mud pit, and then circulating the drilling mud water in the annulus between the pipes. The drill pipe is an ordinary pipe that has neither nozzle pipes nor double walls, and may be jointed to another pipe in an ordinary manner to make a drill string conforming to the depth to be drilled.

In order to regenerate an old well, the second through fourth steps of operation described in the cited patent document have to be followed after the above described first step.

In the second step of the cited patent document, the existing casing pipe is cut off at a depth near the top of packing gravel which is drilled in the first step and pulled out to the surface. The sequence of the first and second steps is repeated until the casing pipe is removed out to a predetermined depth.

Then, in the third step, the tightly compacted formation materials of the borehole wall in the aquifer zone of the old well are scraped to an appropriate extent with a reaming tool and taken out to the surface. This third step may be omitted as described in the cited patent document.

Finally, in the fourth step, installation of new casing pipe with new well screen and well development are carried out in the same manner as used in the common well construction.

Each of the aforesaid nozzles, which are fabricated in the flange part of the lower extremity of the drill pipe with their axis running downward from the inside toward the outside of the drill pipe, has a smaller opening diameter on the outside than the opening diameter on the inside which enhances the drilling effect together with drill cutters integrated therein.

DETAILED DESCRIPTION OF THE PREFERRED EMBODIMENT

Figure 1:
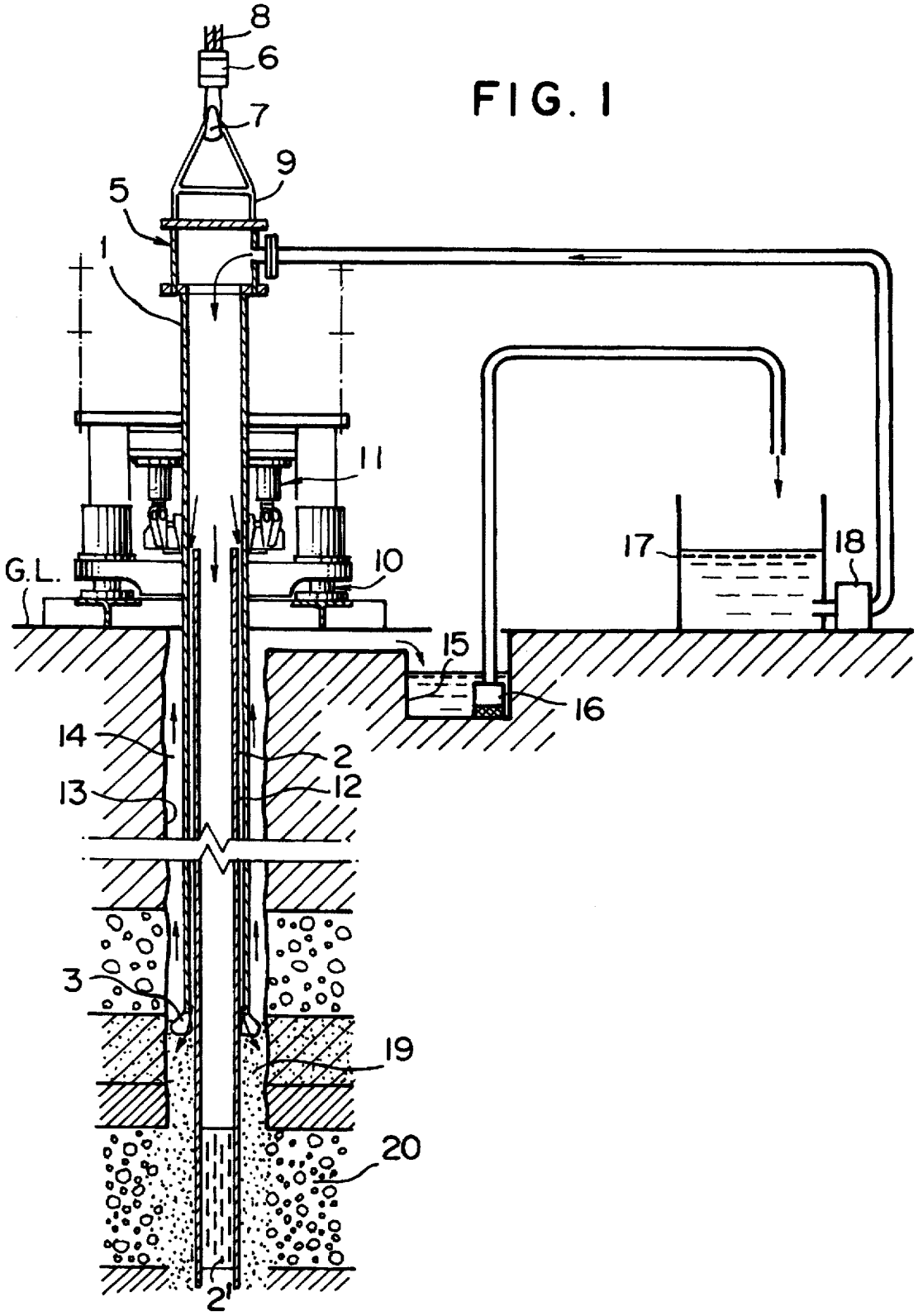
FIG. 1 is a lateral, sectional view of an old well with an existing casing pipe, illustrating the method of drilling packing gravel around the casing pipe in accordance with the invention.
Figure 2:
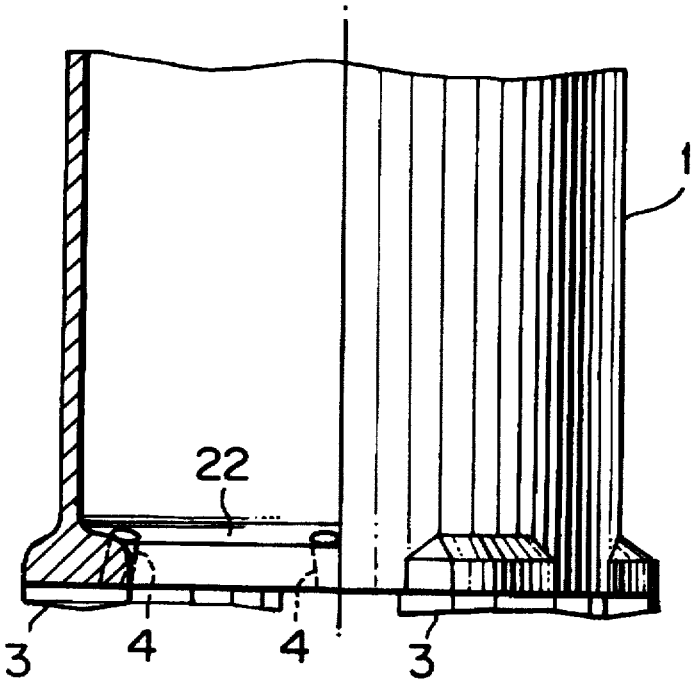
FIG. 2 is a partial, sectional view of the lower extremity of the drill pipe designed for use in accordance with the method of the invention.
Figure 3:
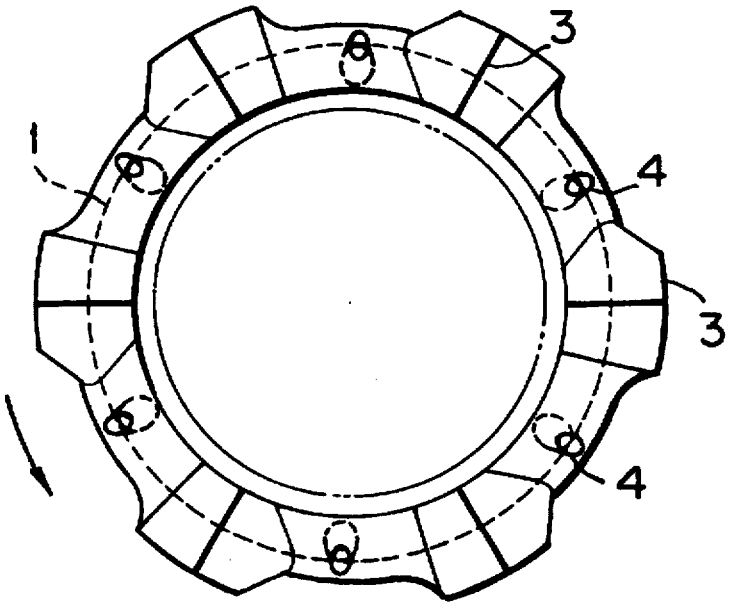
FIG. 3 is an end view of the drill pipe of FIG. 2.

The casing pipe of an old well is filled with drilling mud water in advance. With this preliminary arrangement, the drilling mud water flows out of the well screen to the packing gravel and aquifer to some extent and the clay material of the drilling mud water seals the pores of the aquifer so that any further intrusion of the pressurized drilling mud water into the aquifer can be prevented during the drilling operation.

Then, a drill pipe jointed to the water swivel is set on the old well in axial alignment with the casing pipe and connected to the lifting and rotating equipment.

The drill pipe is rotated and lowered while the drilling mud water is delivered under pressure into the drill pipe by mud pump from mud tank through water swivel. The drill pipe drills the packing gravel and formation around the casing pipe of the old well by means of the drill cutters fitted to the bottom thereof, while the pressurized mud water flows down through the annulus between the existing casing pipe and the drill pipe until it is eventually jetted from the bit nozzles toward the bottom of the drilled hole. The pressurized drilling mud water goes up through the outer annulus between the drill pipe and the borehole wall at a velocity greater than the descending velocity of the cuttings, and delivers cutting to a mud pit at the surface. The drilling mud water returned to the surface is separated from earth particles sized larger than silt, and circulated again by the mud pump.

When the drill bit encounters the aquifer, some amount of the pressurized drilling mud water is lost in the aquifer. However, any formation pores passing the drilling mud water are immediately filled with fine and colloidal particles contained in the drilling mud water, further loss of the drilling mud water is prevented, and the drilling operation can be continued without any problem.

The drilling mud water velocity in the annulus between the two pipes can be set at a desired level. The ascending velocity of the drilling mud water in the annulus between the drill pipe and borehole wall is normally selected at a rate of 0.4 m/sec. to 0.5 m/sec.

The friction loss of the circulating drilling mud water increases with the depth of the well. If the loss is not so high as to cause any problem on the pressure allowance of the mud pump, it does not affect drilling operation. This is the same as in the operation of an ordinary mud rotary drilling machine.

Subsequently, aforesaid second through fourth steps are carried out for the regeneration of an old well. Each step is similar to those described in detail in the cited patent document.

The second step comprises the following operations. A casing pipe cutting device consisting of the cutting nozzle and inside slip is lowered with wire in the casing pipe and placed in a predetermined position. Then, the wire suspending the cutting device is raised so that the inside slip is moved upward by means of a wedge part and firmly settled on the inner surface of the casing pipe. By the inside slip tightly holding the casing pipe, the casing pipe cutting nozzle itself is also firmly positioned and aligned with the casing pipe. Pressurized water is sent to the cutting nozzle and the rotating shaft of the cutting device is rotated by an electric motor. With this rotation of the shaft, an arm of the cutting device is rotated and in turn the cutting nozzle is also horizontally rotated, shooting a water jet against the inner surface of the casing pipe and cutting the pipe. When the casing pipe is completely cut, the cutting device is lifted up together with the cut portion of the casing pipe to the surface.

Whenever necessary, the sequence of the first and second steps is repeated until the predetermined section of the casing pipe in the old well is completely removed.

Then, in the third step, by using an ordinary direct rotary well drilling machine with a reaming tool (a reaming bit with extendable blades), the borehole wall in the aquifer zone of the old well is scraped. The scraped cuttings are removed out to the surface. This third step may be omitted if it is not necessary for the regeneration of the old well.

Finally, in the fourth step, new casing is installed in the borehole of the old well and the annular space around the well screen section is packed with gravel of appropriate grain size. And, after carrying out common well development, the entire process of regenerating the old well will be finished.

If the top of an old well casing is held open and the inside of the casing pipe is filled with mud water from the initial stages of the operation of drilling for the old well regeneration, the mud water gradually enters into the aquifer and pores of the aquifer may become filled with fine and colloidal particles. Then, no further mud water may be lost into the aquifer when the drill pipe encounters the aquifer.

Since each of the aforesaid nozzles located in a flange portion of the drill bit features its axis running downward from the inside toward the outside of the drill pipe and its opening with the outside diameter smaller than the inside, they can effectively eject the pressurized drilling mud water, which is forced down in the annulus between the existing casing pipe and the drill pipe, against the bottom of the hole in order to cool the drill cutters and remove the cuttings from the bottom of the hole, and can enhance the drilling capability of the drill cutters fitted below.

Now, the present invention will be described further by referring to the accompanying drawings.

In the drawings, reference number 1 denotes a drill pipe which has an inside diameter greater than the outside diameter of the existing pipe of the old well. The six drill cutters 3 which are integrated into the lower extremity of the drill pipe are arranged radially, regularly spaced apart. Six nozzles 4 are arranged between the adjacent drill cutters in an alternate manner. The number of drill cutters and nozzles may be altered if necessary.

The drill pipe 1 is then connected to a water swivel 5 and located in an axial alignment with the existing casing pipe 2 of the old well. This procedure may be carried out in any manner selected from a number of known methods including the usage of a traveling block 6 with a hook 7, and a hoisting bail 9 suspended from a mast or derrick (not shown) as illustrated in FIG. 1 or alternatively, the usage of a lift mechanism 10 and a rotary drive mechanism 11 as illustrated in FIGS. 6 and 7, which correspond to FIGS. 5 and 6 in the above cited document, Japanese Patent Application No. 6-309643, or a combination thereof.

While being rotated, the drill pipe 1 is lowered around the existing casing pipe 2 of the old well while the drilling mud water is delivered under pressure into the drill pipe by the mud pump from the mud tank through the water swivel. The drill pipe drills the packing gravel and formation around the casing pipe by means of the drill cutters 3 fitted to the lower extremity thereof, while the pressurized mud water flows down through the annulus 12 between the existing casing pipe 2 and the drill pipe 1 until it is eventually jetted from the bit nozzles 4 toward the bottom of the drilled hole. The pressurized drilling mud water goes up through the outer annulus 14 between the drill pipe 1 and the wall of the drilled hole 13 at a velocity greater than the descending velocity of the cuttings, and delivers the cuttings to a mud pit 15 at the surface.

The circulation of the mud water is well-known. The mud pit 15 is connected to the annulus 14 outside the drill pipe.

A mud tank 17 receives the mud water pumped up by the sand pump 16 in the mud pit 15. The mud pump 18 circulates the mud water from the mud tank 17 to the drill pipe 1 through the water swivel 5.

Figure 5:
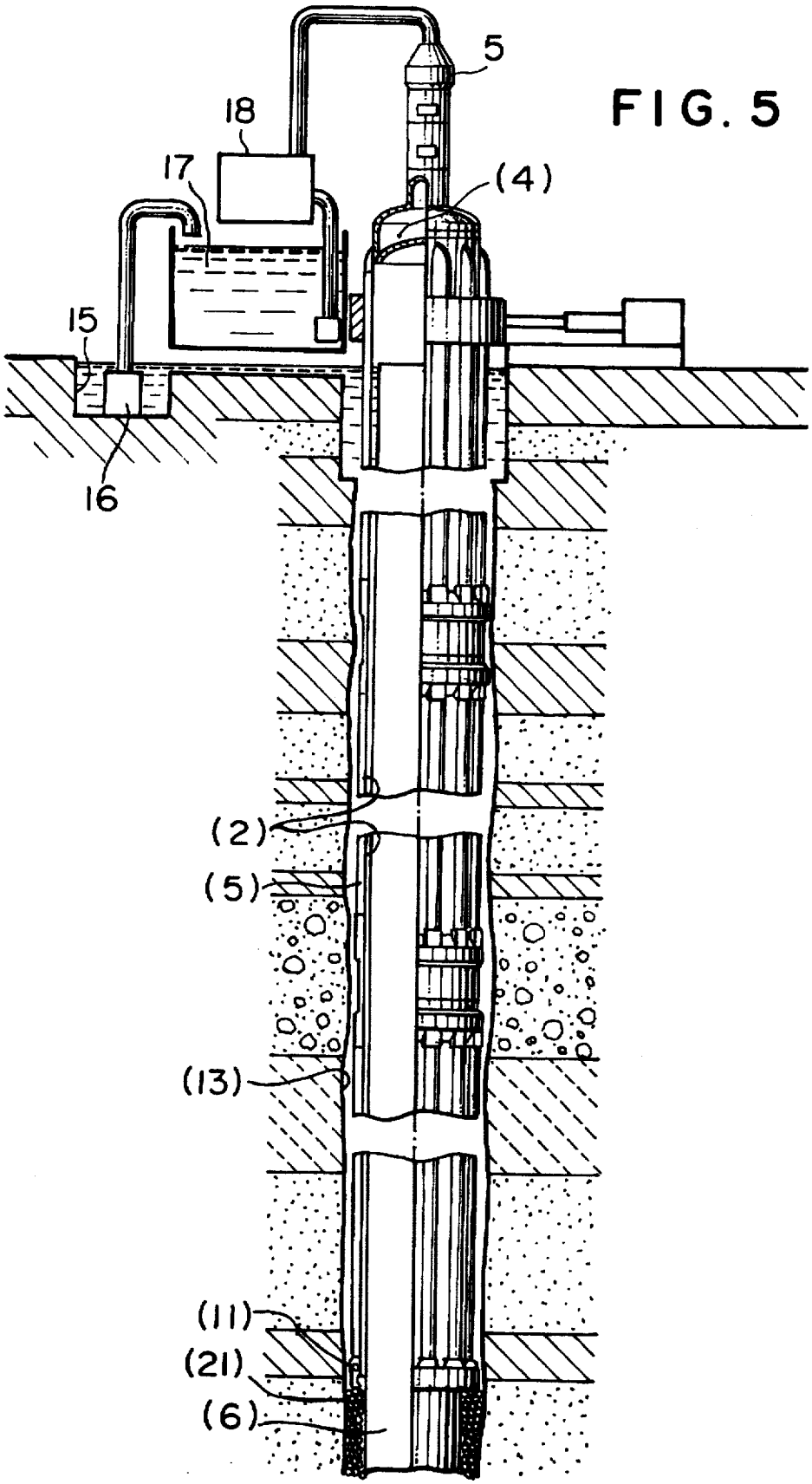
FIG. 5 is a copy of FIG. 1 of the drawings, accompanying document of Japanese Patent Bulletin No. 6-173567.
Figure 6:
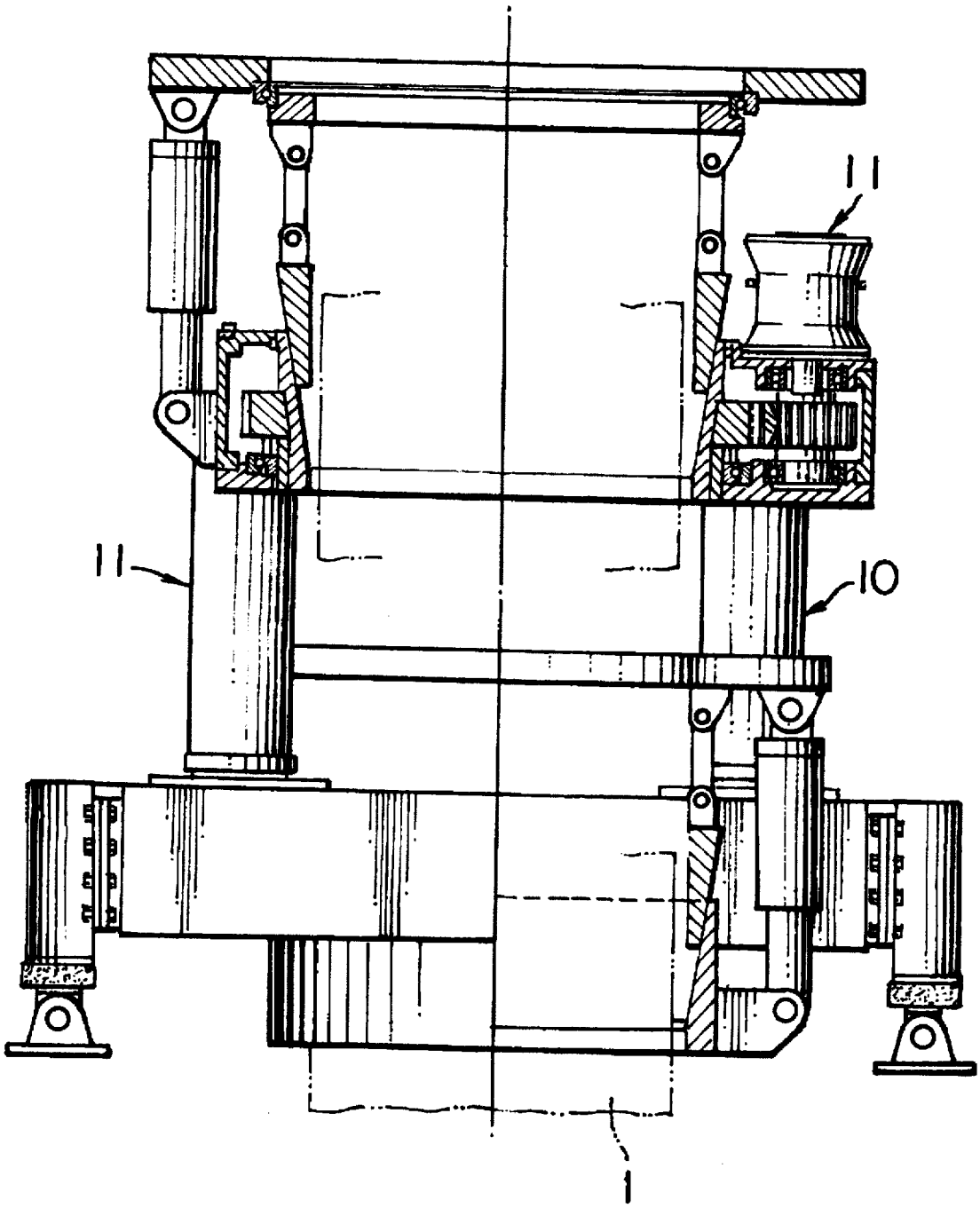
FIG. 6 is a copy of FIG. 5 of the drawings, accompanying document of Japanese Patent Application No. 6-309643.
Figure 7:
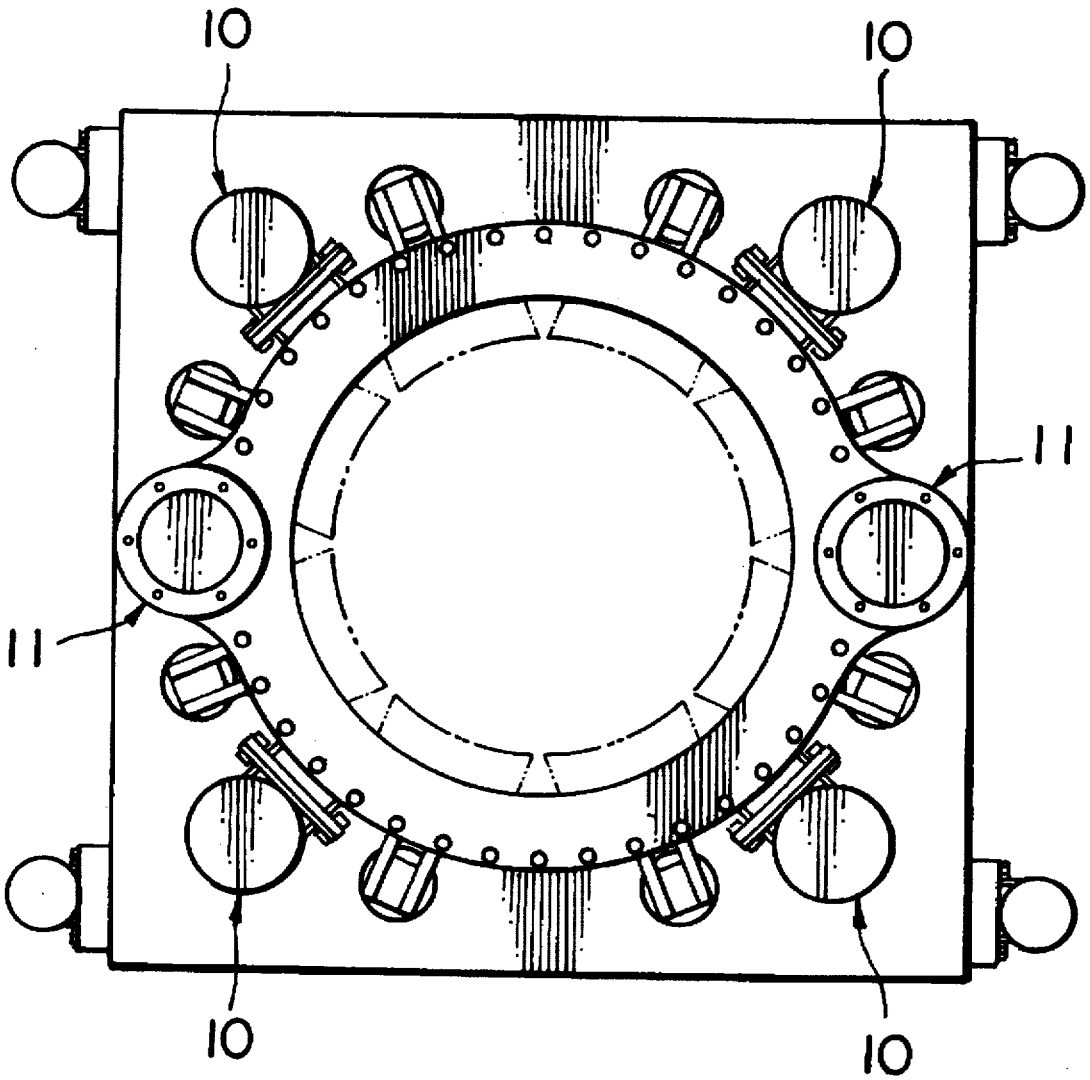
FIG. 7 is a copy of FIG. 6 of the drawings, accompanying document of Japanese Patent Application No. 6-309643.

The mechanism for rotating and pulling up the drill pipe 1 is similar to the one illustrated in FIGS. 7 and 8 which correspond to FIGS. 5 and 6 in the above cited document, Japanese Patent Application No. 6-309643.

As the drill pipe 1 is lowered and rotated, the drill cutters 3 fitted at the lower extremity thereof drill the packing gravel and formation around the casing pipe 2 of the old well. At the same time mud water is circulated under pressure into the drill pipe 1 by the mud pump 18 from the mud tank 17 through the water swivel 5. The pressurized drilling mud water flows down through the annulus 12 between the existing casing pipe 2 and the drill pipe 1 until it is eventually jerred out from the bit nozzles 4 toward the bottom of the drilled hole. The pressurized drilling mud water carrying the excavated cuttings flows up through the outer annulus 14 between the drill pipe 1 and the wall of the drilled hole 13 at a velocity greater than the descending velocity of the cuttings and goes into a mud pit 15 at the surface. The mud water is separated therein from earth particles sized larger than silt, pumped up by the sand pump 18 to the mud tank 17, and then circulated again by the mud pump 18 to the drill pipe 1 through the water swivel 5.

As the drill pipe 1 is further lowered and eventually hits the packing gravel 19, the drill cutters 3 and the mud water jetted from the bit nozzles 4 drill the packing gravel 19 and formation around the existing casing pipe 2. The drilled cuttings (gravel and other formation materials) are carried and displaced into the mud pit 15 at the surface by the mud water which flows up through the annulus 14 between the drill pipe 1 and the wall of the drilled hole 13 at a velocity greater than the descending velocity of the cuttings. The cuttings settle in the mud pit 15.

When drilling the packing gravel 19 is completed, the drill pipe 1 is pulled out of the drilled hole.

The aforesaid second through fourth steps of operation follow after completed the procedure of the present invention and not directly relate to the present invention. These steps, therefore, will not be described here any further. Reference should be made to the above cited document, Japanese Patent Bulletin No. 6-173567.

The top of the casing pipe 2 of the old well is open during the operation in accordance with the method of the invention. Thus, if the casing pipe 2 of the old well is filled with mud water in the initial stages of the operation of drilling the old well for regeneration, some drilling mud water may flow out of the well screen 2' to the packing gravel and aquifer 20. The fine and colloidal particles contained in the drilling mud water seal the pores in the aquifer to some extent so that any further intrusion of the pressurized drilling mud water to the aquifer can be prevented when the drill pipe 1 encounters the aquifer.

Figure 4:
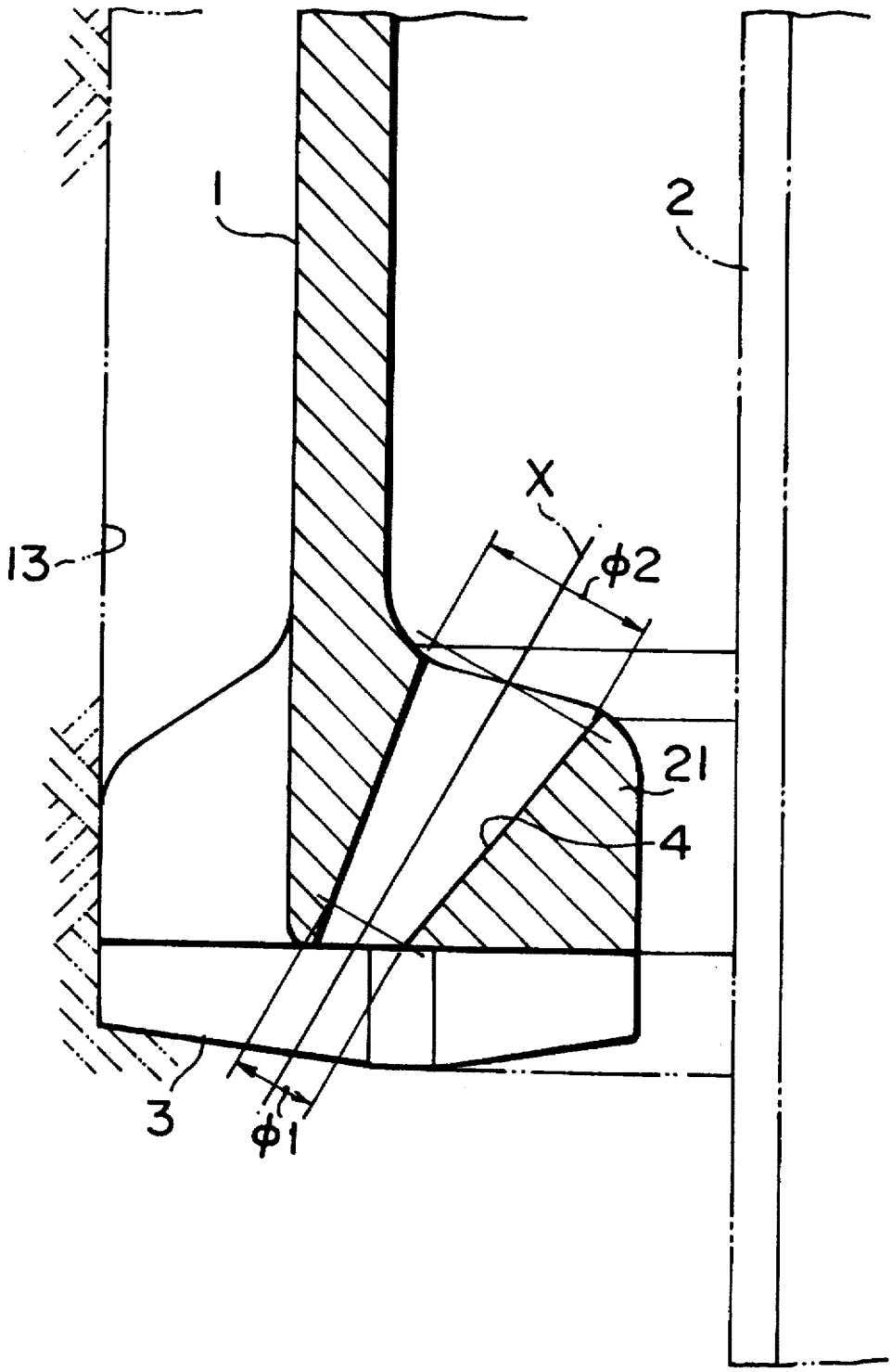
FIG. 4 is an enlarged partial, sectional view of the drill pipe of FIG. 2, showing the nozzle in detail.

As illustrated in FIG. 4, the above described nozzles 4 run through a flange part 21 located at the lower extremity of the drill pipe 1 with their axis running downward from the inside toward the outside of the drill pipe 1. Because the opening (dia. 1) on the outside of the nozzle is smaller than the opening (dia. 2) on the inside the pressurized mud water through the annulus 12 between the casing pipe 2 of the old well and the drill pipe 1 can be ejected against the bottom of the drilled hole 13 of the old well through the nozzles 4 to cool the drill cutters 3 and excavate and remove the cuttings from the hole bottom, and can greatly enhance the drilling capability of the drill cutters fitted below.

[Advantage of the Invention]

As described above in detail, if the inside of the existing casing pipe is filled with the drilling mud water from the initial stages of drilling the old well for regeneration, some drilling mud water flows in the aquifer through the well screen of the casing pipe and the packing gravel and closes pores of the aquifer with fine and colloidal particles. Therefore, further occurance of the drilling mud water loss is prevented and the drilling operation can be continued without any problem.

By using the annulus between the casing pipe of the old well and the drill pipe as a flow path for the pressurized mud water, the nozzle pipes in the known method can be omitted to simplify the operation of drilling around the existing casing pipe.

The pressurized mud water flows down through the clearance between the casing pipe of the old well and the drill pipe and is jetted toward the bottom of the drilled hole from the bit nozzles. This effectively cools the drill cutters and enhances the drilling effect together with the drill cutters which are integrated in the lower extremity of the drill pipe.

What is claimed is:

1. A method of drilling packing gravel and formation materials around an existing casing pipe in order to regenerate an old well, wherein the method comprises the steps of sequentially filling the inside of the casing pipe of the old well with mud water, connecting a drill pipe, which has an inside diameter greater than the outside diameter of the existing casing pipe of the old well and is furnished with a drill bit consisting of drill cutters and nozzles at the lower extremity, to an water swivel, setting the drill pipe in axial alignment with the existing casing pipe, rotating and lowering the drill pipe while sending the pressurized drilling mud water through the annulus between the drill pipe and the casing pipe, drilling the packing gravel and formation materials encountered surrounding the casing pipe with the drill bit, moving the cuttings up to the surface by the drilling mud water which ascends the annulus between the drill pipe and the borehole wall at the velocity greater than the descending velocity of the cuttings, separating the cuttings from the drilling mud water in a mud pit, and then circulating the pressurized drilling mud water in the annulus between the pipes.

2. A method of drilling packing gravel and formation materials around an existing casing pipe in order to regenerate an old well according to claim 1, wherein said nozzles run through a flange part of the lower extremity of the drill pipe with their axis running downward from the inside toward the outside of the drill pipe, having a smaller opening diameter on the outside than the opening diameter on the inside, and enhance the drilling effect together with the drill cutters located therein.

* * * * *